US012372308B2

(12) United States Patent
Tarapoom et al.

(10) Patent No.: US 12,372,308 B2
(45) Date of Patent: Jul. 29, 2025

(54) MICROCHANNEL HEAT EXCHANGER

(71) Applicants: PTT Global Chemical Public Company Limited, Bangkok (TH); PTT Public Company Limited, Bangkok (TH)

(72) Inventors: Nattapong Tarapoom, Bangkok (TH); Kawisra Sompech, Bangkok (TH); Nichaporn Sirimungkalakul, Bangkok (TH)

(73) Assignees: PTT Global Chemical Public Company Limited, Bangkok (TH); PTT Public Company Limited, Bangkok (TH)

( * ) Notice: Subject to any disclaimer, the term of this patent is extended or adjusted under 35 U.S.C. 154(b) by 685 days.

(21) Appl. No.: 17/330,355

(22) Filed: May 25, 2021

(65) Prior Publication Data

US 2021/0278139 A1 Sep. 9, 2021

Related U.S. Application Data

(63) Continuation of application No. PCT/TH2019/000056, filed on Nov. 7, 2019.

(30) Foreign Application Priority Data

Nov. 26, 2018 (TH) ..... 1801007286

(51) Int. Cl.
*F28D 9/00* (2006.01)
*F28F 3/04* (2006.01)

(52) U.S. Cl.
CPC ..... *F28D 9/0037* (2013.01); *F28F 3/048* (2013.01); *F28F 2260/02* (2013.01)

(58) Field of Classification Search
CPC ..... F28D 9/0037; F28D 1/0316; F28D 1/03; F28F 3/048; F28F 3/046; F28F 3/025; F28F 3/02
(Continued)

(56) References Cited

U.S. PATENT DOCUMENTS 4,749,032 A * 6/1988 Rosman ..... F28D 9/0037 29/890.039
6,622,519 B1 9/2003 Mathias et al.
(Continued)

FOREIGN PATENT DOCUMENTS

WO 2018124980 A2 7/2018

OTHER PUBLICATIONS

International Search Report and Written Opinion dated May 13, 2020 in connection with International Application No. PCT/TH2019/00056, 8 pages.
(Continued)

*Primary Examiner* — Tho V Duong
(74) *Attorney, Agent, or Firm* — Baker & McKenzie LLP

(57) ABSTRACT

A microchannel heat exchanger comprising: at least one high temperature heat exchanging plate and at least one low temperature heat exchanging plate stacked in an alternating sequence, wherein an inlet of high temperature fluid and an outlet of high temperature fluid are disposed in order to pass the high temperature fluid through each said high temperature heat exchanging plate, and an inlet of low temperature fluid and an outlet of low temperature fluid are disposed in order to pass the low temperature fluid through each said low temperature heat exchanging plate, wherein the high temperature heat exchanging plate comprising the high temperature microchannel and the low temperature heat exchanging plate comprising the low temperature microchannel, wherein said channels have a length extending in
(Continued)

the flow direction of fluids, and the side wall of each said channel has a symmetric wavy pattern with the center line of each said channel as a symmetric axis, wherein the high temperature heat exchanging plate and the low temperature heat exchanging plate are arranged in the pattern in which the high temperature microchannel and the low temperature microchannel are aligned.

9 Claims, 8 Drawing Sheets

(58) Field of Classification Search
USPC ..... 165/165, 166, 167
See application file for complete search history.

(56) References Cited

U.S. PATENT DOCUMENTS 8,485,247 B2 * 7/2013 Lavric ..... B01L 3/502746 165/181
2009/0104488 A1 4/2009 Gruss et al.
2010/0032147 A1 2/2010 Valenzuela
2012/0138266 A1 * 6/2012 Yamada ..... F28F 13/02 165/104.11
2014/0326432 A1 * 11/2014 Dean ..... F28F 9/26 165/104.14
2015/0316326 A1 * 11/2015 Choi ..... F28F 19/006 165/166
2016/0282064 A1 * 9/2016 Yoon ..... F28F 9/026
2018/0164051 A1 6/2018 Noishiki et al.

OTHER PUBLICATIONS

International Preliminary Report on Patentability completed Oct. 20, 2020 (mailed Oct. 30, 2020) in connection with International Application No. PCT/TH2019/000056, 18 pages.

* cited by examiner a)

b)

c)

a)

b)

c)

MICROCHANNEL HEAT EXCHANGER

CROSS-REFERENCE TO RELATED APPLICATIONS

This application is a continuation of and claims priority to International Application No. PCT/TH2019/000056, filed on Nov. 7, 2019, titled "A Microchannel Heat Exchanger," which claims priority to Thailand Application No. 1801007286 filed on Nov. 26, 2018, both of which are incorporated by reference in their entirety for all purposes.

TECHNICAL FIELD

Chemical engineering relates to a microchannel heat exchanger.

BACKGROUND OF THE INVENTION

Until present, there have been reports on the development of microchannel heat exchanger. When compared to the normal size channels, the microchannels provide a higher heat transfer performance than normal heat exchanger, such as a shell and a tube heat exchanger and a plate and a frame heat exchanger. This is because the flow in microchannels can transfer heat from a channel wall into fluid faster wherein fluids in each channel have similar flow cross section temperatures, a heat transfer surface area of the microchannel is higher than the normal size channel at the same volume, and a pressure drop in the channel is relatively low as compared to the normal heat exchanger. However, the microchannels have some disadvantages that lead to limitation for application. For example, it is easily to be clogged because the channel is narrow, especially the possibility in fabrication in the industrial scale.

It is known that the character of the channel of the heat exchanger is important to the heat exchanging performance of the heat exchanger and the character of the channel is a parameter to indicate the possibility in fabrication and the arrangement of the channel together. Therefore, there have been attempts continuously to develop the character of the channel in order to increase the performance of the heat exchanger and overcome the limitations previously said.

US20040031592 disclosed the heat exchanger comprising the microchannel for the heat exchanging of three or more fluid streams, wherein the wall of said channel was flat with fins disposed in order to increase the heat transfer surface area. However, the installation of said fins increased a fouling rate inside the heat exchanger. Therefore, this reduced the heat exchanging performance rapidly and increased the pressure drop of the heat exchanger. Moreover, said design might have a problem when using with high pressure fluid, leading to a limitation.

U.S. Pat. No. 4,516,632 disclosed the microchannel heat exchanger comprising the slotted heat exchanging plate and unslotted heat exchanging plate stacked in an alternating sequence, wherein the slotted heat exchanging plate was placed in 90 degree with respect to one another in an alternating sequence in order to form a cross-flow configuration of fluids having different temperatures. However, said flow configuration did not give high heat exchanging performance.

EP1875959 disclosed the preparation process of an emulsion with the installation of the heat exchanger comprising the microchannel heat exchanging plate stacked in an alternating sequence, wherein said channel was designed like a snake shape. This provided two flowing patterns in said channel: a counter-current direction and a co-current direction. However, said channel design led to easily clogging of the contaminants and was more difficult to clean than the one flow direction path from one side to another side of the channel.

U.S. Pat. No. 8,858,159 disclosed a gas turbine engine comprising the cooling channels for the low temperature air to flow pass in order to reduce heat of blades in the gas turbine engine, wherein said cooling channels were equipped with curved in and out ribs and the pedestals were positioned between each pair of ribs in order to increase the heat exchanging performance. Nevertheless, the character of said pedestals between each pair of ribs might increase the pressure drop of the heat exchanger which was the limitation when applying to heat transfer between fluids with highly different pressures or fluids with high viscosity.

US20100314088 disclosed the heat exchanger comprising the plates consisting of microchannels stacked in an alternating sequence, wherein said plates were designed to be curved and said microchannels were set into non-symmetric wavy pattern providing parallel channels along the flow direction of fluids. The total length of direct portion and curve portion of the channels was set to be constant. However, said patent did not disclose the suitable aspect of said wavy channel such as width size, curve radius, etc.

TH1601007738 disclosed the heat exchanger for heat exchanging of fluids having different temperatures, comprising: at least one flat heat exchanging plate; at least one high temperature heat exchanging plate; and at least one low temperature heat exchanging plate stacked in an alternating sequence. A side wall of each channel had symmetric wavy pattern, wherein the symmetric axis was the center line of each channel. This enhanced the heat exchanging performance. However, there still had limitations: the heat exchanging performance was not high enough and the arrangement of the channel perpendicular to the flow direction was not suitable. These limitations made the possibility in fabrication of the invention in the industrial scale difficult.

From all above reasons, this invention aims to provide the microchannel heat exchanger having high heat exchanging performance, decreasing problems related to the heat exchanger for fluids having highly different pressures, and having ease in fabrication of the invention in the industrial scale.

SUMMARY OF INVENTION

This invention aims to provide the microchannel heat exchanger having high heat exchanging performance, decreasing problems related to the heat exchanger for fluids having highly different pressures, and having ease in fabrication of the invention in the industrial scale.

In one aspect of the invention, this invention discloses the microchannel heat exchanger comprising: at least one high temperature heat exchanging plate and at least one low temperature heat exchanging plate stacked in an alternating sequence, wherein an inlet of high temperature fluid and an outlet of high temperature fluid are disposed in order to pass the high temperature fluid through each said high temperature heat exchanging plate, and an inlet of low temperature fluid and an outlet of low temperature fluid are disposed in order to pass the low temperature fluid through each said low temperature heat exchanging plate, wherein the high temperature heat exchanging plate comprising the high temperature microchannel and the low temperature heat exchanging plate comprising the low temperature microchannel, wherein said channels have a length extending in the flow direction of fluids, and the side wall of each said channel has a symmetric wavy pattern with the center line of each said channel as a symmetric axis, wherein the high temperature heat exchanging plate and the low temperature heat exchanging plate are arranged in the pattern in which the high temperature microchannel and the low temperature microchannel are aligned.

DESCRIPTION OF THE INVENTION

The present invention relates to the heat exchanger comprising the plate having microchannel as described according to the following embodiments.

Any aspect used herein refers including the application to other aspects of this invention unless stated otherwise.

Technical terms or scientific terms used herein have definitions as understood by an ordinary person skilled in the art unless stated otherwise.

Any tools, equipment, methods, or chemicals mentioned herein mean tools, equipment, methods, or chemicals commonly operated or use by those person skilled in the art unless explicated that they are tools, equipment, methods, or chemicals specific only in this invention.

Use of singular noun or singular pronoun with "comprising" in claims or specification refers to "one" and also "one or more", "at least one", and "one or more than one".

The following details describe in the specification of the invention, and are not intend to limit the scope of the invention in any way. This invention discloses the microchannel heat exchanger comprising: at least one high temperature heat exchanging plate and at least one low temperature heat exchanging plate stacked in an alternating sequence, wherein an inlet of high temperature fluid and an outlet of high temperature fluid are disposed in order to pass the high temperature fluid through each said high temperature heat exchanging plate, and an inlet of low temperature fluid and an outlet of low temperature fluid are disposed in order to pass the low temperature fluid through each said low temperature heat exchanging plate, wherein the high temperature heat exchanging plate comprising the high temperature microchannel and the low temperature heat exchanging plate comprising the low temperature microchannel, wherein said channels have a length extending in the flow direction of fluids, and the side wall of each said channel has a symmetric wavy pattern with the center line of each said channel as a symmetric axis, wherein the high temperature heat exchanging plate and the low temperature heat exchanging plate are arranged in the pattern in which the high temperature microchannel and the low temperature microchannel are aligned.

Figure 1:
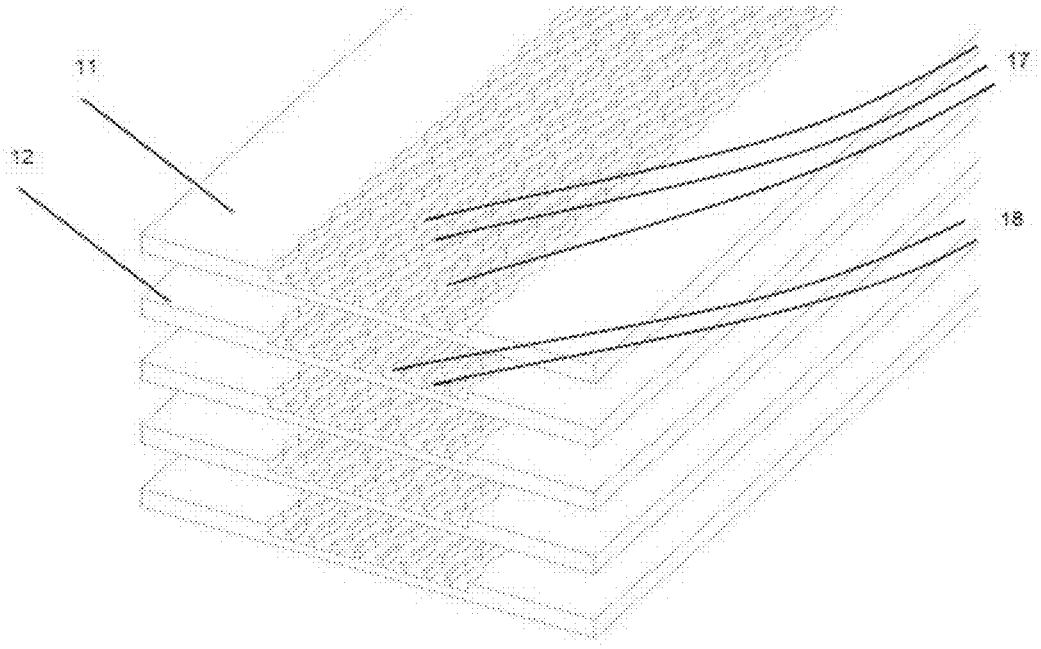
FIG. 1 shows one aspect of the heat exchanger according to the present invention, comprising: at least one high temperature heat exchanging plate and at least one low temperature heat exchanging plate.

FIG. 1 shows one aspect of the heat exchanger according to the present invention. In this aspect, the microchannel heat exchanger comprising: at least one high temperature heat exchanging plate 11 and at least one low temperature heat exchanging plate 12 stacked in an alternating sequence, wherein an inlet of high temperature fluid 13 and an outlet of high temperature fluid 14 are disposed in order to pass the high temperature fluid through each said high temperature heat exchanging plate 11, and an inlet of low temperature fluid 15 and an outlet of low temperature fluid 16 are disposed in order to pass the low temperature fluid through each said low temperature heat exchanging plate 12, wherein the high temperature heat exchanging plate 11 comprising the high temperature microchannel 17 and the low temperature heat exchanging plate 12 comprising the low temperature microchannel 18, wherein said channels have a length extending in the flow direction of fluids, and the side wall of each said channel has a symmetric wavy pattern with the center line of each said channel as a symmetric axis, wherein the high temperature heat exchanging plate 11 and the low temperature heat exchanging plate 12 are arranged in the pattern in which the high temperature microchannel 17 and the low temperature microchannel 18 are aligned.

Figure 2:
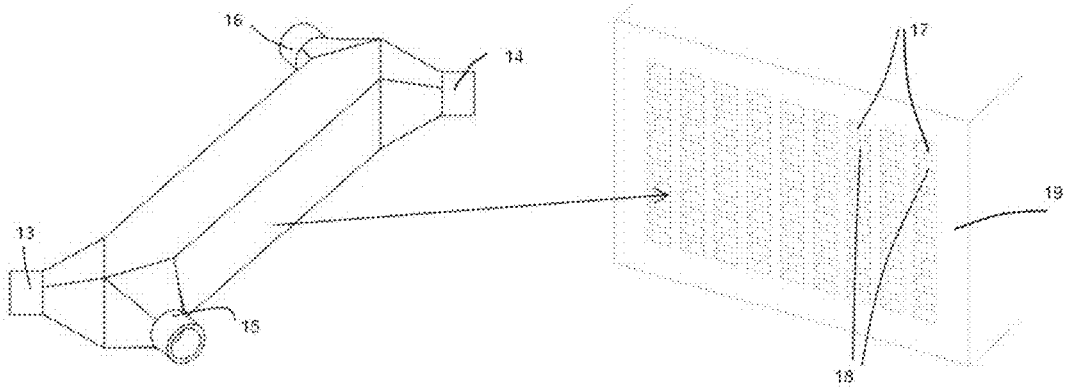
FIG. 2 shows one aspect of the heat exchanger according to the present invention, comprising: at least one high temperature heat exchanging plate; at least one low temperature heat exchanging plate; and at least one flat heat exchanging plate.
Figure 3:
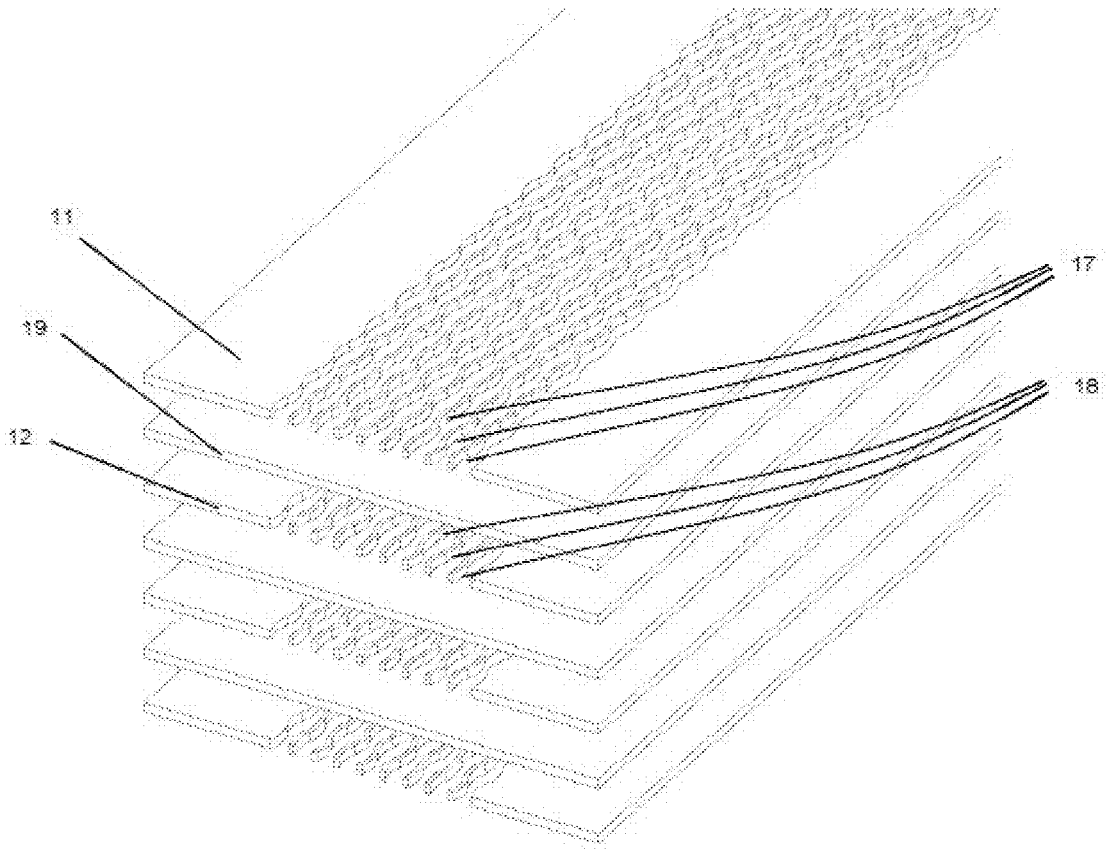
FIG. 3 shows one aspect of the arrangement of the heat exchanging plate of the heat exchanger according to the present invention.
Figure 4:
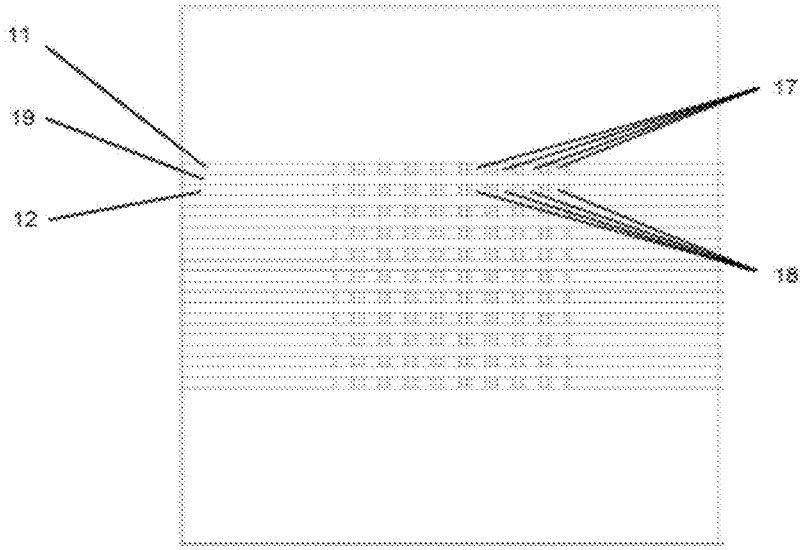
FIG. 4 shows one aspect of the arrangement of the heat exchanging plate of the heat exchanger according to the present invention which is perpendicular to the flow direction.

FIG. 2, FIG. 3, and FIG. 4 show another aspect of the heat exchanger according to the present invention. In this aspect, the microchannel heat exchanger comprising: at least one high temperature heat exchanging plate 11; at least one low temperature heat exchanging plate 12; and at least one flat heat exchanging plate 19 stacked in an alternating sequence, wherein an inlet of high temperature fluid 13 and an outlet of high temperature fluid 14 are disposed in order to pass the high temperature fluid through each said high temperature heat exchanging plate 11, and an inlet of low temperature fluid 15 and an outlet of low temperature fluid 16 are disposed in order to pass the low temperature fluid through each said low temperature heat exchanging plate 12, wherein the high temperature heat exchanging plate 11 comprising the high temperature microchannel 17 and the low temperature heat exchanging plate 12 comprising the low temperature microchannel 18, wherein said channels have a length extending in the flow direction of fluids, and the side wall of each said channel has a symmetric wavy pattern with the center line of each said channel as a symmetric axis, wherein the high temperature heat exchanging plate 11 and the low temperature heat exchanging plate 12 are arranged in the pattern in which the high temperature microchannel 17 and the low temperature microchannel 18 are aligned.

Figure 5:
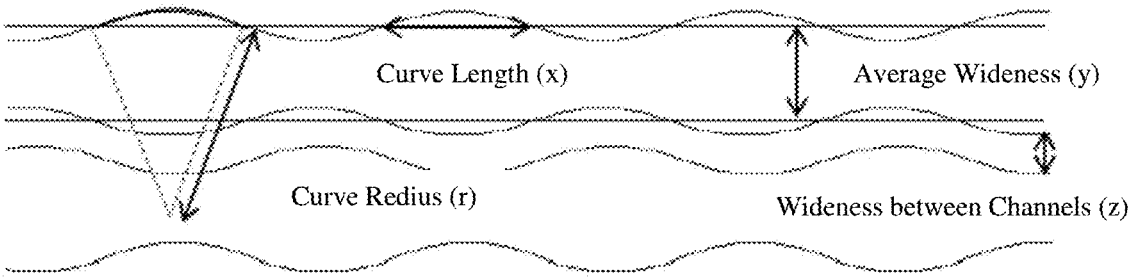
FIG. 5 shows one aspect of each high temperature microchannel and each low temperature microchannel of the heat exchanger according to the present invention.

In one embodiment, each channel of the high temperature microchannel 17 and the low temperature microchannel 18 as shown in FIG. 5 wherein said channels have an average width (y) in a range of 100 to 5,000 μm, a width between channels (z) in a range of 100 to 5,000 μm, and a curve length (x) and a curve radius (r) according to the following equation:

$$\chi \leq 2r;$$

wherein x is in a range of 100 to 100,000 μm.

Preferably, the high temperature microchannel 17 and the low temperature microchannel 18 have the average width (y) in the range of 1,000 to 3,000 μm, the width between channels (z) in the range of 1,000 to 3,000 μm, the curve length (x) in the range of 1,000 to 5,000 μm, and the curve radius (r) in the range of 1,000 to 5,000 μm.

In one embodiment, the high temperature heat exchanging plate 11, the low temperature heat exchanging plate 12, and the flat heat exchanging plate 19 have a thickness in a range of 10 to 10,000 μm, preferably the thickness in the range of about 100 to 2,000 μm.

In order to perform heat exchanging of fluids having different temperatures effectively with adequate strength and dimensional stability, said heat exchanging plate may be made of carbon steel, stainless steel, aluminum, titanium, platinum, chromium, copper, or alloy thereof, preferably made of stainless steel 316L (SS316L).

Figure 6:
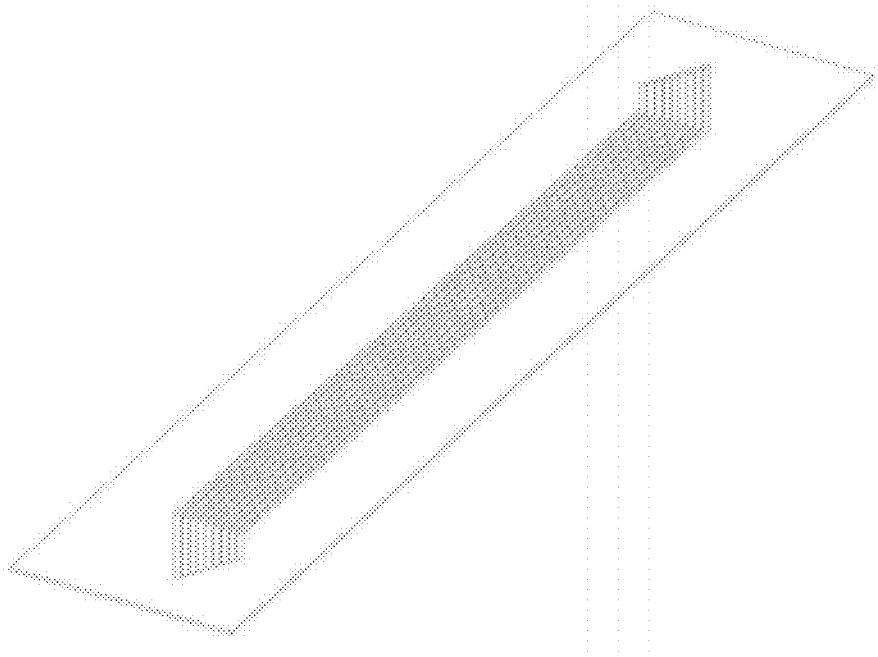
FIG. 6 shows one aspect of the high temperature heat exchanging plate and the low temperature heat exchanging plate of the heat exchanger according to the present invention from a) isometric, b) top, and c) bottom views.
Figure 6:
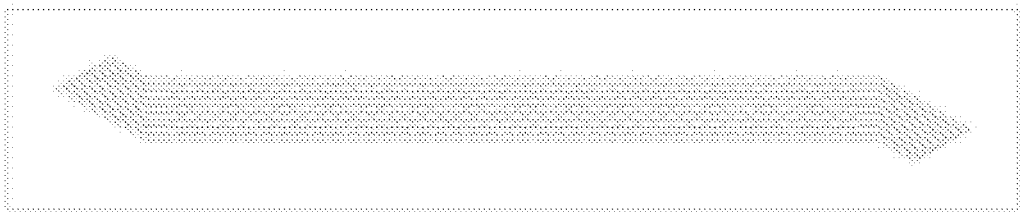
Figure 6:
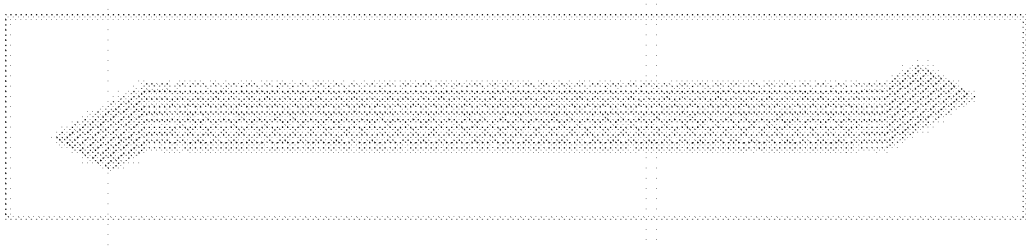
Figure 7:
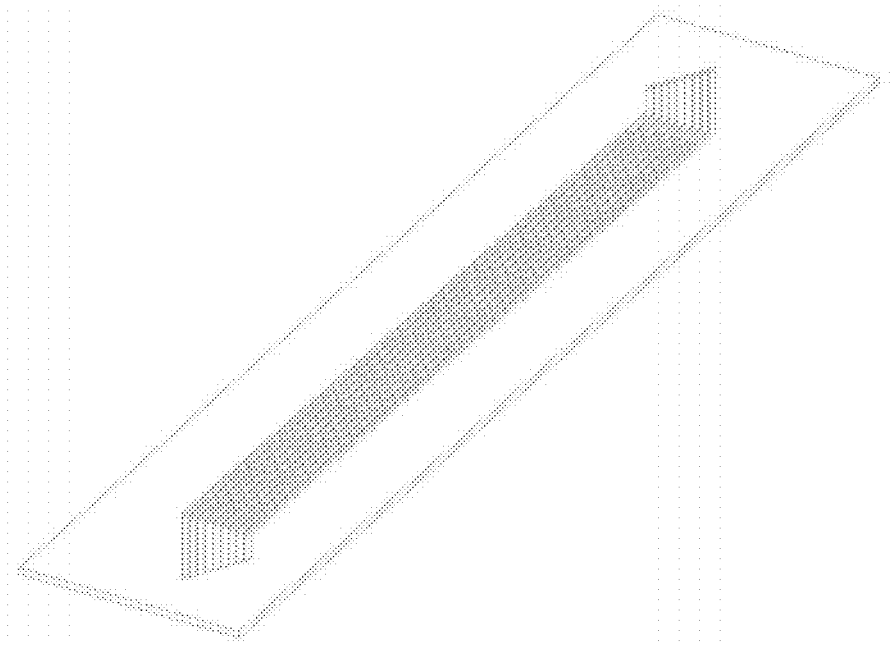
FIG. 7 shows another aspect of the high temperature heat exchanging plate and the low temperature heat exchanging plate of the heat exchanger according to the present invention from a) isometric, b) top, and c) bottom views.
Figure 7:
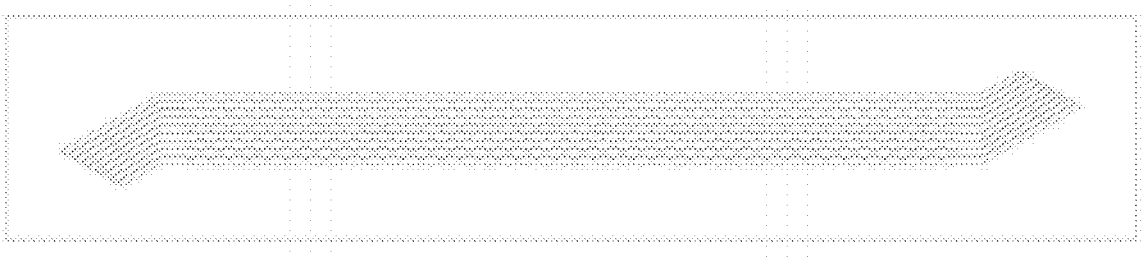
Figure 7:
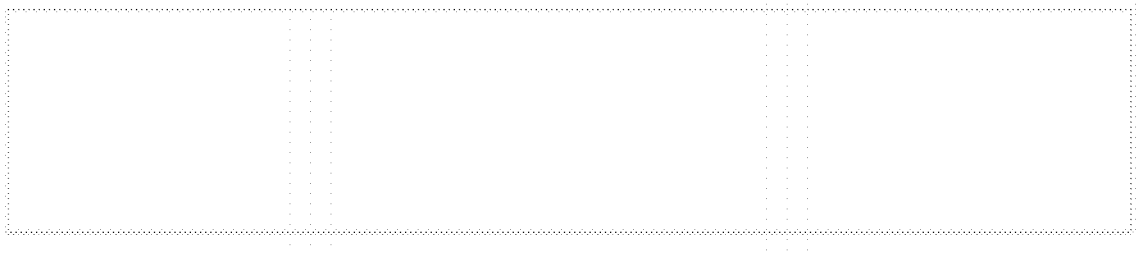

In one embodiment, the high temperature heat exchanging plate 11 and the low temperature heat exchanging plate 12 may be formed by using wire cut fabrication technique, photo chemical machine (PCM) fabrication technique, or computer numerical control milling machine technique, wherein the characters of the obtained plate are as shown in FIG. 6 or may be formed by using photo chemical machine (PCM) fabrication technique or computer numerical control milling machine technique, wherein the characters of the obtained plate are as shown in FIG. 7.

Said heat exchanging plate may be bonded by diffusion bonding process, wherein the bonding caused by the diffusions of the atoms of the workpiece in each side across their contact surface resulted in the homogeneity of such surface, wherein the important factors of the bonding are temperature, time, pressure at the contact surface, surface roughness and environments of the diffusion bonding process.

In one embodiment, the inlet of high temperature fluid 13 and the inlet of low temperature fluid 15 are disposed in an opposite side of the heat exchanger in order to cause fluids having different temperatures to flow in the counter-current direction, wherein said fluids having different temperatures have a temperature difference at least 1° C., preferably the temperature difference at least 10° C.

As being known by an ordinary person skilled in the art that said high temperature heat exchanging plate 11 and said low temperature heat exchanging plate 12 can be stacked in an alternating sequence from two plates and more. Moreover, said high temperature heat exchanging plate 11, said low temperature heat exchanging plate 12, and said flat heat exchanging plate 19 can be stacked in an alternating sequence from three plates and more. These plates can be stacked in higher numbers in order to provide the heat exchanger with many channels for heat exchanging of fluids with high flow rate.

Figure 8:
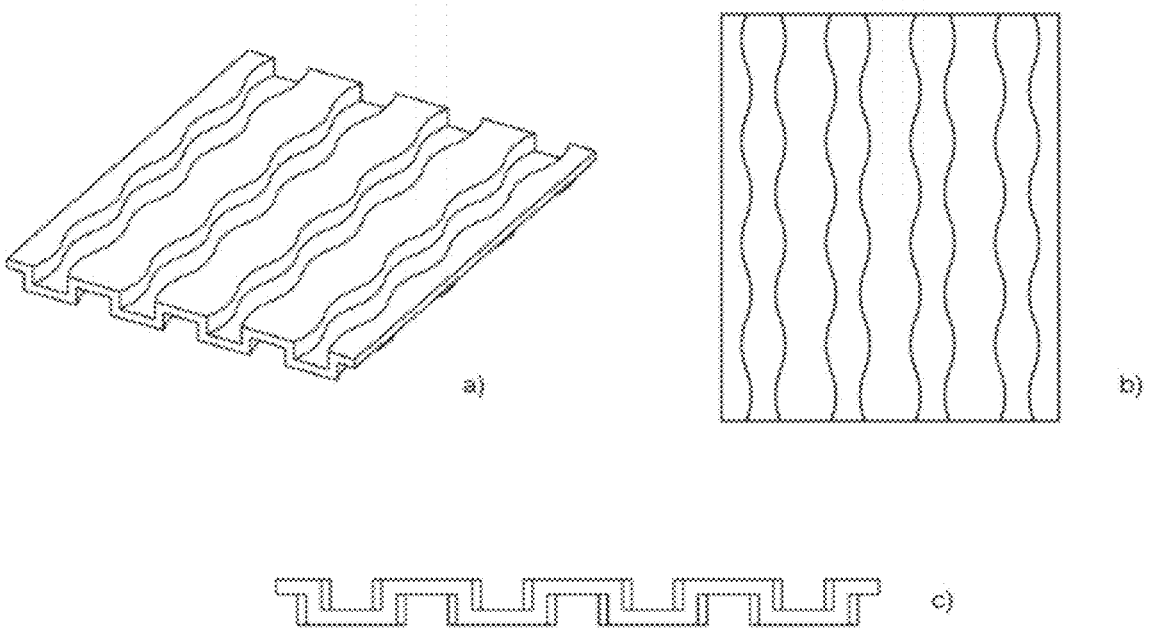
FIG. 8 shows one aspect of the high temperature heat exchanging plate and the low temperature heat exchanging plate of the comparative heat exchanger comprising the symmetric wavy channel and the arrangement of the heat exchanging plate in order to provide an alternating sequence between the high temperature channel and the low temperature channel from a) isometric, b) top, and c) front views.
Figure 9:
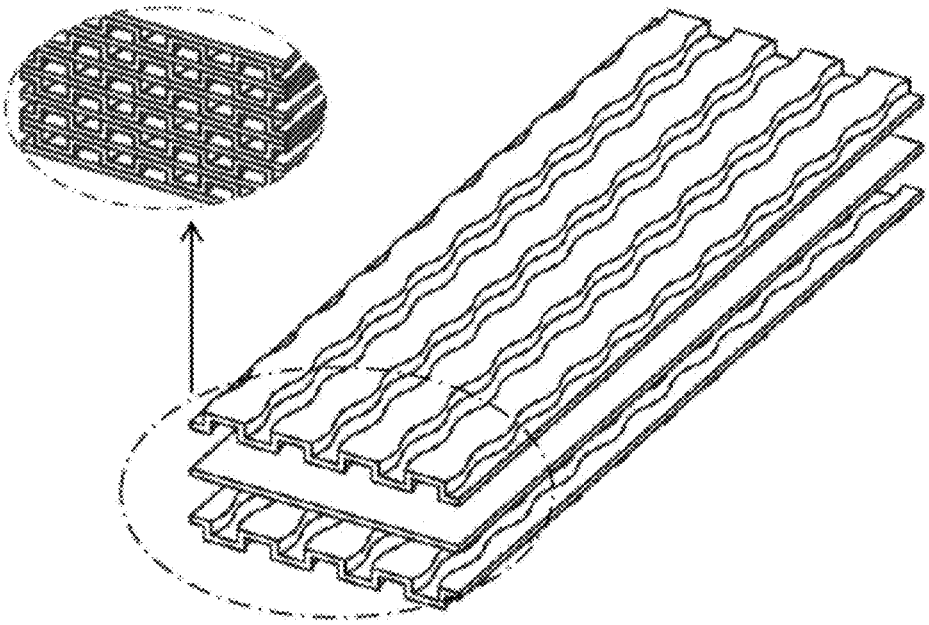
FIG. 9 shows one aspect of the arrangement of the heat exchanging plate of the heat exchanger according to FIG. 6.

In order to compare the performance of the heat exchanger according to the present invention in FIG. 2 to the heat exchanger comprising the channel according to the prior art, the heat exchanger comprising the high temperature channel and the low temperature channel having symmetric wavy wall according to the appearance in FIGS. 8 and 9, and the heat exchanger comprising the high temperature channel and the low temperature channel having non-symmetric wavy pattern and straight channel (according to the appearance in FIGS. 10 and 11 respectively) were build and tested with the computational fluid dynamics model using ANSYS Fluent software version 19.1 as being described below.

Heat Exchanger According to this Invention

Heat Exchanger 1

The flat heat exchanging plate 19 had the thickness about 0.5 mm, and the high temperature heat exchanging plate 11 and the low temperature heat exchanging plate 12 had the thickness about 1 mm. The high temperature microchannel 17 and the low temperature microchannel 18 as shown in FIG. 5 had the average width (y) about 2,000 μm, the curve length (x) about 3,000 μm, the curve radius (r) about 4,000 μm, the width between channels (z) about 0.5 mm, and the length of channel about 240 mm.

Heat Exchanger 2

The flat heat exchanging plate 19 had the thickness about 1 mm, and the high temperature heat exchanging plate 11 and the low temperature heat exchanging plate 12 had the thickness about 1 mm. The high temperature microchannel 17 and the low temperature microchannel 18 as shown in FIG. 5 had the average width (y) about 2,000 μm, the curve length (x) about 3,000 μm, the curve radius (r) about 4,000 μm, the width between channels (z) about 0.5 mm, and the length of channel about 240 mm.

Heat Exchanger 3

The flat heat exchanging plate 19 had the thickness about 0.5 mm, and the high temperature heat exchanging plate 11 and the low temperature heat exchanging plate 12 had the thickness about 1 mm. The high temperature microchannel 17 and the low temperature microchannel 18 as shown in FIG. 5 had the average width (y) about 2,000 μm, the curve length (x) about 3,000 μm, the curve radius (r) about 4,000 μm, the width between channels (z) about 1 mm, and the length of channel about 240 mm.

Heat Exchanger 4

The flat heat exchanging plate 19 had the thickness about 1 mm, and the high temperature heat exchanging plate 11 and the low temperature heat exchanging plate 12 had the thickness about 1 mm. The high temperature microchannel 17 and the low temperature microchannel 18 as shown in FIG. 5 had the average width (y) about 2,000 μm, the curve length (x) about 3,000 μm, the curve radius (r) about 4,000 μm, the width between channels (z) about 1 mm, and the length of channel about 240 mm.

Comparative Heat Exchanger

Heat Exchanger A

The heat exchanger comprising the compositions as described in the heat exchanger 1 except that the high temperature heat exchanging plate and the low temperature heat exchanging plate having thickness about 0.5 mm and the arrangement of the heat exchanging plate providing an alternating sequence between the high temperature channel and the low temperature channel as shown in FIG. 9 was used.

Heat Exchanger B

Figure 10:
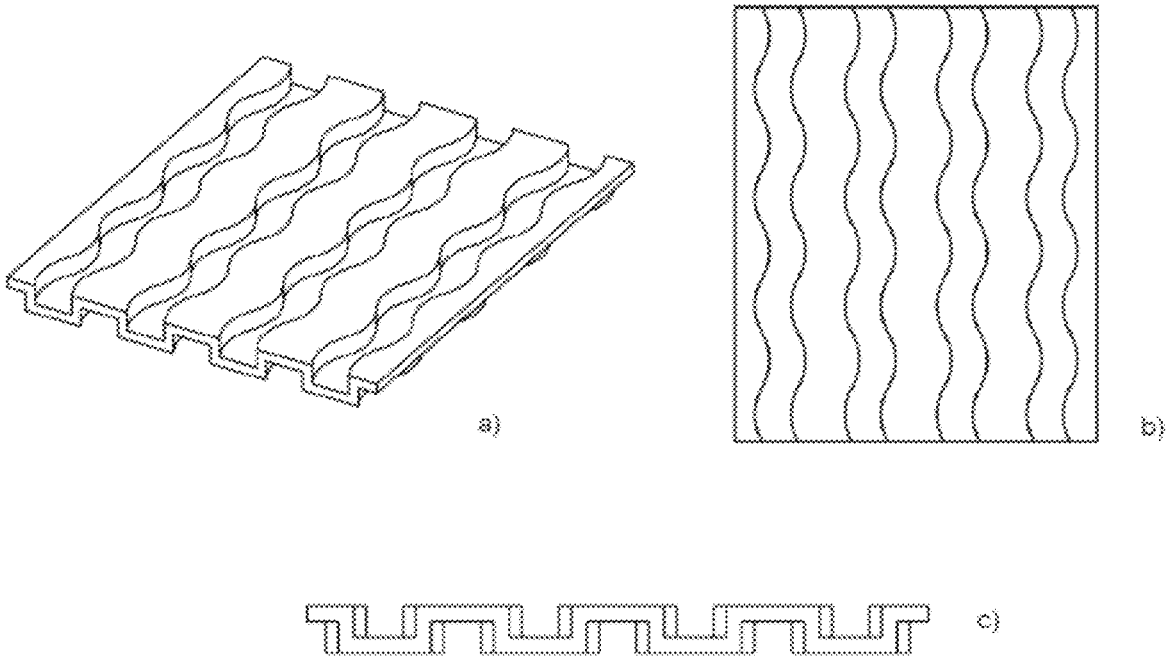
FIG. 10 shows one aspect of the high temperature heat exchanging plate and the low temperature heat exchanging plate of the comparative heat exchanger comprising the non-symmetric wavy channel from a) isometric, b) top, and c) front views.

The heat exchanger comprising the compositions as described in the heat exchanger 1 except that the high and low temperature channels having the non-symmetric wavy pattern and the high temperature heat exchanging plate and the low temperature heat exchanging plate having thickness about 0.5 mm as shown in FIG. 10 was used.

Heat Exchanger C

Figure 11:
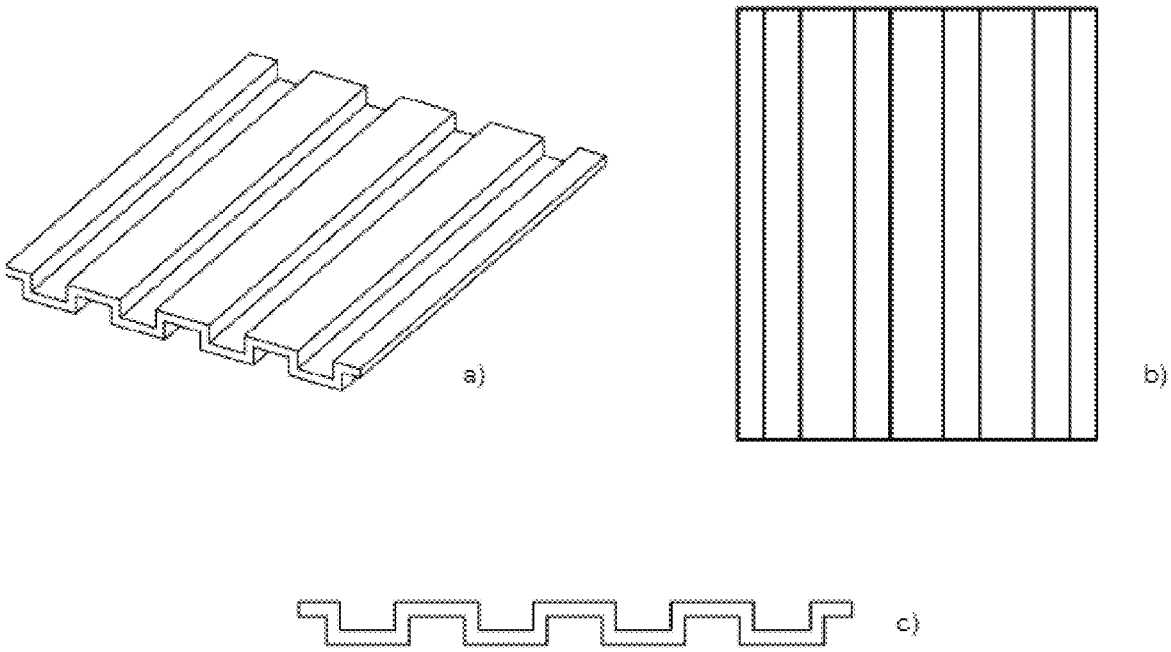
FIG. 11 shows one aspect of the high temperature heat exchanging plate and the low temperature heat exchanging plate of the comparative heat exchanger comprising the straight channel from a) isometric, b) top, and c) front views.

The heat exchanger comprising the compositions as described in the heat exchanger 1 except that the high and low temperature channels having straight character along the flow direction and the high temperature heat exchanging plate and the low temperature heat exchanging plate having thickness about 0.5 mm as shown in FIG. 11 was used.

The heat exchanger comprising different characters of the channel as described above was tested for heat exchanging performance with the computational fluid dynamics model using ANSYS Fluent software version 19.1 with the following parameters. Fluids used in the model were water at different temperatures, wherein the high temperature fluid was about 80° C. and the low temperature fluid was about 20° C. The said fluids flowed in the counter-current direction with flow rate in each path about 111 mL/min. The results were shown in table 1.

TABLE 1 shows the temperature of the high temperature fluids outlet and the temperature of the low temperature fluids outlet, and the heat exchanging rate of the heat exchanger comprising different characters.

| Heat exchanger | Temperature of the high temperature fluids outlet (° C.) | Temperature of the low temperature fluids outlet (° C.) | Heat Exchanging rate (Kcal/hr) | Percentage of increasing heat exchanging performance* |
|---|---|---|---|---|
| A | 64.1 | 35.9 | 3,980 | 94 |
| B | 66.6 | 33.1 | 3,346 | 63 |
| C | 71.8 | 28.2 | 2,049 | 0 |
| 1 | 63.1 | 36.9 | 4,230 | 106 |
| 2 | 63.8 | 36.2 | 4,065 | 98 |
| 3 | 62.7 | 37.2 | 4,324 | 111 |
| 4 | 63.4 | 36.5 | 4,163 | 103 |

*Comparative percentage of increasing heat exchanging performance to the heat exchanger C was calculated from the following equation:

$$\text{Percentage of increasing heat exchanging performance for the heat exchanger } X = \frac{(\text{heat exchanging rate of } C - \text{heat exchanging rate of } X)}{\text{heat exchanging rate of } C} \times 100$$

From table 1, when comparing the heat exchanger according to the present invention 1, 2, 3, and 4 to the comparative heat exchanger A, B, and C, it was found that the heat exchanger according to the present invention gave higher heat exchanging rates, wherein the heat exchanger according to the present invention 3 provided highest performance.

Moreover, in order to compare the performance of the heat exchanger in size aspect between the heat exchanger according to the present invention and the heat exchanger comprising the channel according to the prior art, the heat exchanger comprising different characters of the channel as described above was subjected to the size comparison by considering the channel area perpendicular to the flow direction comprising the high temperature channel for two channels, the low temperature channel for two channels, and the flat heat exchanging plate placed between the high and the low temperature channels. The results were shown in table 2.

TABLE 2 shows the comparison of the channel area perpendicular to the flow direction of the heat exchanger comprising different characters

| Heat exchanger | Total perpendicular channel area ($mm^2$) | Percentage of decreasing heat exchanger area** |
|---|---|---|
| A | 20 | 0 |
| B | 20 | 0 |
| C | 20 | 0 |
| 1 | 15 | 25 |
| 3 | 18 | 10 |

**The percentage of decreasing heat exchanger area comparing to the heat exchanger C was calculated from the following equation:

$$\text{Percentage of decreasing heat exchanger area for the heat exchanger } X = \frac{(\text{Total perpendicular channel area } C - \text{Total perpendicular channel area } X)}{\text{Total perpendicular channel area } C} \times 100$$

Table 2 shows the comparison of the channel area perpendicular to the flow direction of the heat exchanger according to the present invention to the heat exchanger according to the prior art, which could be considered from the total channel area perpendicular to the flow direction and the percentage of decreasing heat exchanger area. From the table, it was found that the heat exchangers according to the present invention 1 and 3 were smaller but provided higher heat exchanging performance than the heat exchanger according to the prior art.

From the above results, it is confirmed that the heat exchanger according to the present invention is effective in the heat exchanging of fluids having highly different temperatures and 5 is smaller in size. Then, the production cost is decreased. This gives the possibility in fabrication of the invention in the industrial scale as being said in the objectives of this invention.

BEST MODE OF THE INVENTION

Best mode of the invention is as provided in the description of the invention.

What is claimed is:

1. A microchannel heat exchanger comprising:

at least one high temperature heat exchanging plate (11) and at least one low temperature heat exchanging plate (12) stacked in an alternating sequence, wherein an inlet of high temperature fluid (13) and an outlet of high temperature fluid (14) are disposed in order to pass a high temperature fluid through each said high temperature heat exchanging plate (11), and an inlet of low temperature fluid (15) and an outlet of low temperature fluid (16) are disposed in order to pass a low temperature fluid through each said low temperature heat exchanging plate (12), wherein the high temperature heat exchanging plate (11) comprising a high temperature microchannel (17) and the low temperature heat exchanging plate (12) comprising a low temperature microchannel (18), wherein said channels have a length extending in a flow direction of fluids, and a side wall of each said channel has a symmetric wavy pattern with a center line of each said channel as a symmetric axis, wherein the high temperature heat exchanging plate (11) and the low temperature heat exchanging plate (12) are arranged in a pattern in which the high temperature microchannel (17) and the low temperature microchannel (18) are aligned in a vertical direction.

2. The microchannel heat exchanger according to claim 1, wherein the heat exchanger further comprising a flat plate (19).

3. The microchannel heat exchanger according to claim 1, wherein the high temperature microchannel (17) and the low temperature microchannel (18) have an average width (y) in a range of 100 to 5,000 pm, a width between the channels (z) in a range of 100 to 5,000 μm, and a curve length (x) and a curve radius (r) according to the following equation:

$$X \leq 2r$$

wherein x is in a range of 100 to 100,000 pm.

4. The microchannel heat exchanger according to claim 1 or 3, wherein the high temperature microchannel (17) and the low temperature microchannel (18) have the average width (y) in the range of 1,000 to 3,000 μm, the width between the channels (z) in the range of 1,000 to 3,000 μm, the curve length (x) in the range of 1,000 to 5,000 μm, and the curve radius (r) in the range of 1,000 to 5,000 pm.

5. The microchannel heat exchanger according to claim 1 or 2, wherein the high temperature heat exchanging plate (11), the low temperature heat exchanging plate (12), and a flat plate (19) have a thickness in a range of 10 to 10,000|im.

6. The microchannel heat exchanger according to claim 5, wherein the high temperature heat exchanging plate (11), the low temperature heat exchanging plate (12), and the flat plate (19) have the thickness in the range of 100 to 2,000|im.

7. The microchannel heat exchanger according to claim 1, wherein the inlet of high temperature fluid (13) and the inlet of low temperature fluid (15) are disposed on opposite sides of the heat exchanger in order to cause fluids having different temperatures to flow in the counter-current direction.

8. The microchannel heat exchanger according to claim 1 or 7, wherein said fluids having different temperatures have a temperature difference of at least 1° C.

9. The microchannel heat exchanger according to claim 8, wherein said fluids having different temperatures have the temperature difference of at least 10° C.

* * * * *